US006342013B1

(12) United States Patent
Irelan

(10) Patent No.: US 6,342,013 B1
(45) Date of Patent: Jan. 29, 2002

(54) APPARATUS AND METHOD FOR A CHILD'S SUSPENDED MERRY-GO-ROUND

(75) Inventor: Robert D. Irelan, Ceder Bluff, MS (US)

(73) Assignee: FF Acquisition Corp., West Point, MS (US)

( * ) Notice: Subject to any disclaimer, the term of this patent is extended or adjusted under 35 U.S.C. 154(b) by 0 days.

(21) Appl. No.: 09/633,245

(22) Filed: Aug. 7, 2000

Related U.S. Application Data

(63) Continuation of application No. 09/571,998, filed on May 15, 2000, now abandoned.

(51) Int. Cl.[7] ..... A63G 1/12
(52) U.S. Cl. ..... 472/14; 472/32; 472/33
(58) Field of Search ..... 472/29, 32, 35, 472/14, 19, 20

(56) References Cited

U.S. PATENT DOCUMENTS

| | | | | |
|---|---|---|---|---|
| 1,864,734 A | | 6/1932 | Hoppes | |
| 2,152,679 A | * | 4/1939 | Bisch | 472/29 |
| D176,401 S | | 12/1955 | Bauer | |
| 2,843,379 A | * | 7/1958 | Merritt | 472/29 |
| 2,992,824 A | * | 7/1961 | Lew'chuk | 472/32 |
| 3,593,993 A | | 7/1971 | Bonneau | |
| 4,431,183 A | * | 2/1984 | Reimann | 472/32 |
| 4,936,569 A | | 6/1990 | West | |
| 5,118,094 A | | 6/1992 | Lambert | |
| 5,480,355 A | | 1/1996 | Miller | |

OTHER PUBLICATIONS

Swing Station by Swing–N–Slide (1 page; undated but prior to May 15, 2000; unknown place of publication).
Tire–Swing (no known author; 1 page; undated but prior to May 15, 2000; unknown place of publication).
Design Sketches by Klitsner Industrial Design, May 21, 1999 (5 pages).
Design Sketch by Klitsner Industrial Design, May 28, 1999 (1 page).
Design Sketches by Klitsner Industrial Design, (2 pages; undated but prior to May 15, 2000; unknown place of publication).

* cited by examiner

*Primary Examiner*—Kien T. Nguyen
(74) *Attorney, Agent, or Firm*—Brinks Hofer Gilson & Lione

(57) ABSTRACT

A child's suspended merry-go-round preferably includes a vertical pole member, a seat member, tension members to attach the seat member to a bearing attached to the vertical pole member, back supports, and a hand wheel on the pole member. A child seated on the seat member suspended from the pole by flexible tension members connected to the pole may be rotated on the merry-go-round.

31 Claims, 2 Drawing Sheets

APPARATUS AND METHOD FOR A CHILD'S SUSPENDED MERRY-GO-ROUND

RELATED APPLICATION

This application is a continuing application of the U.S. application Ser. No. 09/571,998; filed May 15, 2000, entitled "Apparatus and Method for a Child's Suspended Merry-Go-Round" now abandoned.

BACKGROUND OF THE INVENTION

The invention relates generally to a suspended merry-go-round for children, particularly for use with a swing set.

Many adults no doubt have fond memories of their parents taking them to the park for a ride on a merry-go-round. Today's parent has a hectic work schedule and little free time to take children to the park. Even when a parent has time, many parks are both deteriorated and sometimes unsafe. While it might be nice to relocate the park to one's backyard, it should be appreciated that typical merry-go-rounds are too large for an average backyard. Another problem is that those rides must be secured to the ground, often requiring cement and other anchoring devices that permanently change the landscape of the backyard. A further problem with conventional merry-go-rounds is the lack of a back support to restrain the rider so as to prevent the rider from being thrown off of the merry-go-round and onto the ground, possibly resulting in injury. Yet another problem is the rigidity of the structure, which could strike and injure another child who gets too close to the ride. Still another deficiency in the conventional merry-go-round is that they are either leg-powered or require someone to stand on the ground and push the ride.

Accordingly, there is a need for a new and improved child's merry-go-round apparatus and method that addresses these problems.

SUMMARY OF THE INVENTION

Briefly stated, the invention is an apparatus and a method for a child's suspended merry-go-round.

In accordance with an apparatus aspect, the apparatus includes a vertical pole member having a ground end and a top end. The top end of the vertical pole member is attached to a support beam by a support assembly. The apparatus further has a rotatable seat member having a sitting surface with an opening at its center. The vertical pole member passes through this opening at the center of the seat member. The seat member is attached to the pole member by tension members. That attachment of the tension members to the pole member preferably comprises a bearing.

In accordance with another apparatus aspect, the apparatus includes a vertical pole member having a ground end and a top end. The top end of the vertical pole member is attached to a support beam by a support assembly. The apparatus further has a rotatable seat member having a sitting surface with an opening at its center. The vertical pole member passes through this opening at the center of the seat member. The seat member is attached to the pole by tension members. The apparatus also has a back support.

Still another aspect of the apparatus includes a vertical pole member having a ground end and a top end. The top end of the vertical pole member is attached to a support beam by a support assembly. The apparatus further has a rotatable seat member having a sitting surface with an opening at its center. The vertical pole member passes through this opening at the center of the seat member. The seat member is attached to the pole by tension members. The apparatus also has a hand wheel attached to the vertical pole member and a flexible back support attached to the seat member and to the flexible tension members.

In accordance with a method aspect, the method includes providing a merry-go-round apparatus having a vertical pole member and a seat member with a hole in its center. The pole member passes through this hole in the center of the seat member. One end of the pole member engages to the ground and an opposite end of the pole member is supported to hold the pole member vertical. The method further includes seating a child on the seat member and supporting the seat member with flexible tension members connected between the pole member and the seat member. The method also includes rotating the seat member about the pole member to give the child a ride on the merry-go-round.

DETAILED DESCRIPTION OF THE DRAWINGS AND PREFERRED EMBODIMENTS OF THE INVENTION

With reference to FIGS. 1–5, a new and improved child's suspended merry-go-round embodying aspects of the present invention will be described.

Figure 1:
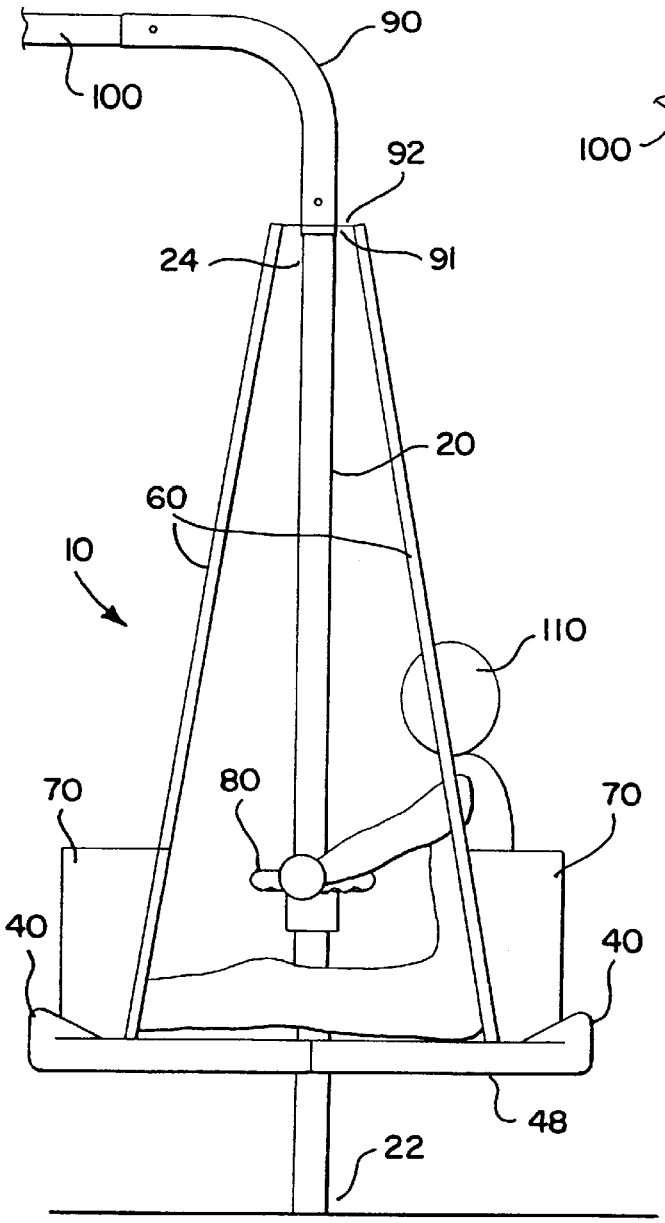
FIG. 1 is a side view of a preferred embodiment of the suspended merry-go-round of the present invention with a child seated on the seat member.

FIG. 1 is a side view of a preferred embodiment of a child's suspended merry-go-round apparatus 10. The apparatus 10 includes several basic components, including a vertical pole member 20, a rotatable seat member 40, flexible tension members 60, back supports 70 and a hand wheel 80.

FRAME

As shown below, given the structural function of the vertical pole member 20, the pole member 20, and the support assembly 90 may be called and referred to as the "frame" of the apparatus.

The vertical pole member 20, which may also be called a "vertical leg," is called a "vertical" pole member because it is preferably 90° to the plane of the ground. The vertical pole member 20 has two ends, a ground end 22 and a top end 24. The ground end 22 is designed to be secured to the ground. Although this is called the ground end 22, it should be understood that it does not necessarily have to be secured in dirt, but may also be in sand, concrete, asphalt, crushed rock, or other surface. However, dirt and sand probably provide the safer surface from the standpoint of the child.

As shown in FIG. 1, the vertical pole member 20 provides the axis of rotation for the merry-go-round. Another function of the vertical pole member 20 is to provide a stable connection to a support assembly 90 that attaches the top end 24 of the pole 20 to a support beam 100. Further, the pole 20 also provides the structure to which flexible tension members 60 attach the rotatable seat member 40. In addition, the pole 20 contains holes allowing for the attachment of a hand wheel 80. Each of these other components—a hand wheel 80, a rotatable seat member 40, flexible tension members 60, and back supports 70—shall be discussed in due course, but it should be understood that the vertical pole member 20 must be durable enough to withstand the weight of these components, the weight of children 110 riding the apparatus, as well as the centrifugal force of the children 110 during rotation, and the net external torque acting on an object rotating about a fixed axis. The pole member 20 also must be constructed of material that is reasonably weather resistant, and constructed of a material that allows attachment of these various components.

Therefore, the vertical pole member 20 is preferably metal formed. It should be understood that the term "metal formed" shall mean preferably of steel construction, although a durable and strong plastic polymer may also be used and shall too be synonymous with "metal formed" where it provides a suitable alternative to steel. The pole member 20 is even more preferably a hollow steel pole, and still more preferably a hollow steel pole measuring 2 inches in diameter by 72.5 inches in height, still more preferably Flexible Flyer® part number 45022.

The top end 24 of the vertical pole member 20 is attached to a support assembly 90 that is connected to a support beam 100 that is preferably a swing set support beam, more preferably a hollow metal swing set support beam and also known as a "top bar."

Figure 2:
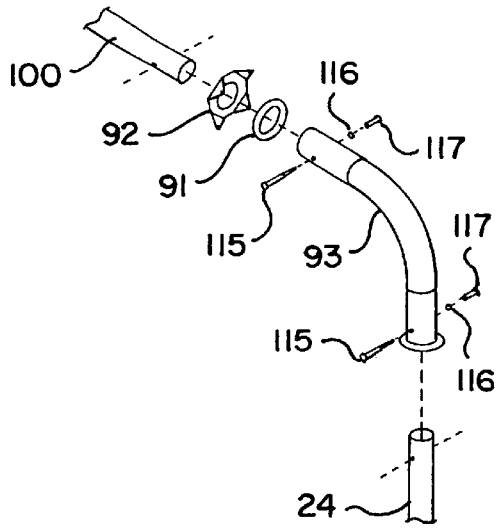
FIG. 2 is an exploded view of a preferred embodiment of the support assembly shown in FIG. 1.

FIG. 2 is an exploded view of a preferred embodiment of the support assembly 90. The support assembly includes a tube 93 with a first end 93A (also known as the "top bar" end) configured so as to fasten to the swing set support beam 100 and a second end 93B configured so as to fasten to the top end 24 of the pole member 20. The tube 93 is preferably a hollow metal formed tube 93, more preferably a metal formed Elbow Tube, still more preferably Flexible Flyer® part number 33000020.

In addition to the tube 93, the support assembly 90 as shown in FIG. 2 may include a bearing washer 91 and a swing support plate 92. The bearing washer 91 is preferably plastic, more preferably a Derlin plastic washer with an internal diameter 2.25 inches, still more preferably Flexible Flyer® part number 25000010. A plastic bearing is sufficient for the weight normally carried in the present invention, and is preferred because it is waterproof. For larger devices, carrying several children, a metal roller bearing may be preferred. The swing support plate 92 preferably is metal formed, more preferably is metal formed with tabs, still more preferably Flexible Flyer® part number 31000010.

The washer 91 and then the swing support plate 92 fit over the tube 93 by sliding onto the tube 93 from the first end 93A until the bearing washer 91 and the swing support plate 92 rest on a bearing support 98. The tabs of the swing support plate 92 should point in the direction of motion (toward the second end 93B of the tube 93). The washer 91 and swing support plate 92 slide onto the tube 93 until both rest on the bearing support 98. The second end 93B of the tube 93 is now ready to secure to the top end 24 of the pole 20, and the first end 93A of the tube 93 is ready to be secured to the swing set support beam 100.

The top end 24 of the vertical pole member 20 is secured to the second end 93B of the tube 93. Preferably, the top end 24 (also known as the hole end) of the pole member 20 inserts into the bearing support 98 end of the tube 93, and is preferably secured with a bolt 115, a washer 116, and a nut 117. The bolt 115 is preferably metal formed, more preferably is metal formed of dimensions 5/16th of an inch by 1¾ of an inch, and still more preferably Flexible Flyer® part number 001354P. The washer 116 is preferably metal formed, more preferably a metal formed lock washer, still more preferably a ⅜ inch metal formed lock washer, and still more preferably Flexible Flyer® part number 001664P. The nut 117 is preferably metal formed, more preferably a metal formed barrel nut, still more preferably a metal formed barrel nut 5/16 inch by 1¼ inch, and still more preferably Flexible Flyer® part number 007002P. The top bar end 93B of the tube 93 slides onto the top bar 100 and are secured with the bolt 115, washer 116, and nut 117. All bolts 115 and nuts 117 are tightened until the washers 116 are flattened.

The first end 93A of the tube 93 is secured to the swing set support beam 100 by sliding the first end 93A of the tube 93 onto the end of the top bar 100. The first end 93A of the tube 93 and the top bar 100 then are secured with a bolt 115, a washer 116, and a nut 117. It does not matter whether the first end 93A is first secured to the beam 100 or the second end 93B is first secured to the top end 24 of the pole 20.

HAND WHEEL

Between the top end 24 of the pole 20 and the ground end 22, the apparatus preferably has a hand wheel 80, which may also be called a "turning wheel" that children may use while riding to apparatus in order to provide the torque that rotates the seat member 40 about the axis of rotation that is the pole member 20.

Figure 3:
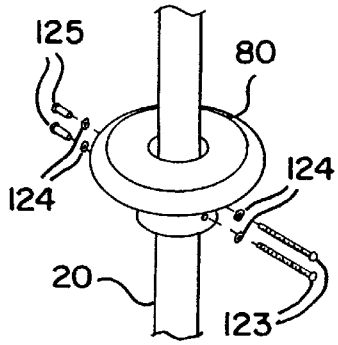
FIG. 3 is an exploded view of a preferred embodiment of how the hand wheel shown in FIG. 1 attaches.

FIG. 3 is an exploded view of a preferred embodiment of the hand wheel 80. The hand wheel 80 has an opening at its center such that it may slide over the vertical pole member 20. The hand wheel preferably is constructed of plastic, more preferably a blow molded plastic, more preferably a blow molded plastic having grooves for the fingers for easier gripping, still more preferably Flexible Flyer® part number 66000030.

The hand wheel 80 in the preferred embodiment has an up side 82 (facing toward the top end 24 of the vertical pole member 20) that is flat and has an extension end 84 that extends toward the ground end 22 of the pole 20 such that the hand wheel 80 may be secured to the pole member. The hand wheel 80, having an opening at its center with an internal diameter preferably the diameter of the vertical pole member 20, slides flat up side 82 up over the pole 20. The hand wheel has holes in the extension end 84 that align with holes in the vertical pole member 20 and allow for the hand wheel 80 to be secured to the pole member 20.

The hand wheel is preferably secured to the pole member 20 above the plane formed by the seat member. The hand wheel 80 is preferably secured by bolts 123, washers 124, and nuts 125. The bolt 123 is preferably metal formed, more preferably is metal formed of dimensions ¼ inch by 3.5 inch, and still more preferably Flexible Flyer® part number 001272P. There are preferably two bolts 123. The washer 124 is preferably metal formed, more preferably a metal formed flat washer, still more preferably a 5/16 inch metal formed flat washer, and still more preferably Flexible Flyer® part number 001618P. There are preferably two washers 124. The nut 125 is preferably metal formed, more preferably a metal formed barrel nut, still more preferably a metal formed barrel nut of dimensions ¼ inch by ¾ inch, and still more preferably Flexible Flyer® part number 007003P. There are preferably two nuts 125. The nuts 125 are tightened in order to secure the hand wheel 80 to the vertical pole member 20.

SEAT MEMBER

A preferred embodiment of the apparatus 10 further includes a rotatable seat member 40 having sitting surface with an opening at its center through which the vertical pole member 20 passes.

Figure 4:
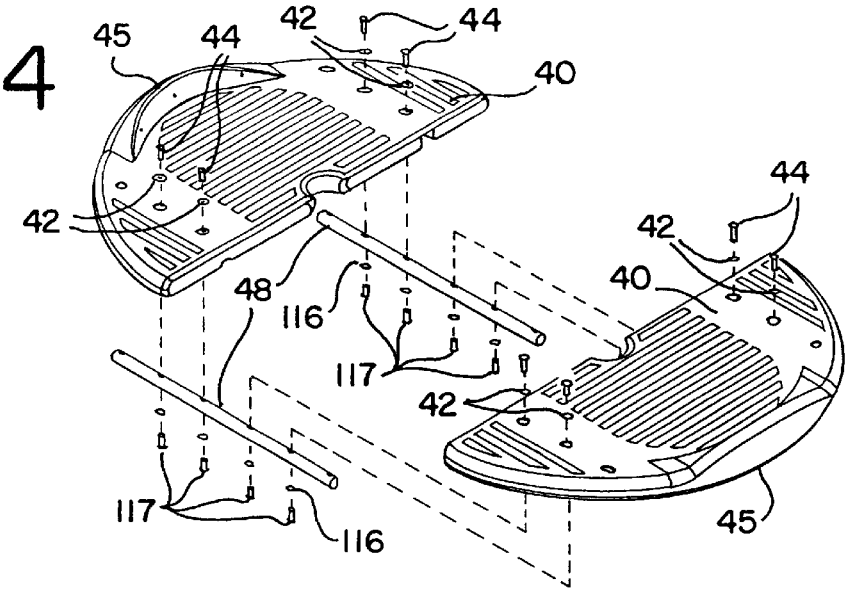
FIG. 4 is an exploded view of a preferred embodiment of the seat member shown in FIG. 1.

FIG. 4 is an exploded view of a preferred embodiment of the seat member 40. The seat member 40 is a substantially flat platform disk, so it may also be known as the "platform" of a preferred embodiment of the apparatus 10. Although substantially flat, the seat member 40 may have raised section 45 for further attachment of back supports 70 as shown later. Each raised section 45 also has at least three holes in a row that is substantially parallel to the surface of the seat member 40 and these holes may be at least 3 inches apart.

The seat member 40 must be constructed of a durably material that can withstand the weight of any children riders, and is preferably constructed of plastic, more preferably a hollow plastic shell, even more preferably an injection or blow molded plastic shell, still more preferably a blow molded plastic shell having two semicircular halves 49 adapted so as to interlock and form the seat member with the opening at its center for the pole member 20 to pass therethrough, and most preferably two Flexible Flyer® part numbers 66000020. The seat member could also be made of wood, and of course could be made of more than two sections.

Each of the interlocking semicircular halves 49 of the seat member 40 contains counter sunk holes 41, preferably round counter sunk holes 41, more preferably at least two round counter sunk holes 41, still more preferably four round counter sunk holes 41 as shown in FIG. 4. For each of the counter sunk holes 41 there is a washer 42 placed in the hole 41, preferably the washer 42 is a flat washer, more preferably a ⅜ inch flat washer, still more preferably Flexible Flyer® part number 001616P.

The two halves 49 of the seat member 40 connect by interlocking. The interlocking semicircular halves 49 of the seat member 40 are preferably even and flush. The halves 49 are further connected by at least one support bar 48 through at least one slot 43 in the seat member 40. There are preferably two support bars 48 through two slots 43 in the seat member 40. The slots 43 are preferably parallel, and more preferably located at the bottom of the seat member 40.

After the two halves 49 of the seat member 40 are interlocked by pushing the halves 49 firmly together, the two support bars 48 are positioned in the bottom slots 43 of the seat member 40 with the counter sunk holes 41 of the halves 49 being aligned with holes in the support bars 48. The support bars 48 are preferably metal formed, more preferably metal formed hollow bar of the dimensions 1 inch by 24 inch, still more preferably Flexible Flyer® part number 30000006.

The halves 49 are secured with bolts 44, washers 116, and nuts 117. The washers 116 and nuts 117 have been previously described. The bolts 44 are preferably metal formed, more preferably metal formed of the dimensions 5⁄16 inch by 1.25 inch, and still more preferably Flexible Flyer® part number 001352P. All of these bolts 44 are tightened through the nuts 117 until the washers 116 are flattened.

BACK SUPPORT

In a preferred embodiment, the apparatus 10 also includes back supports 70. A back support 70 may also be called a "seat back" or a "back rest." The preferred embodiment contains at least two back supports 70. A back support 70 should be constructed of a material that is both comfortable to the rider and is durable to withstand the centrifugal force of the rider. In a preferred embodiment the back support 70 is flexible and may be plastic, canvass, cloth, vinyl, or vinyl mesh. Preferably, there are at least two back supports, more preferably two vinyl mesh back supports, still more preferably two Flexible Flyer® parts number 42000100.

Figure 5:
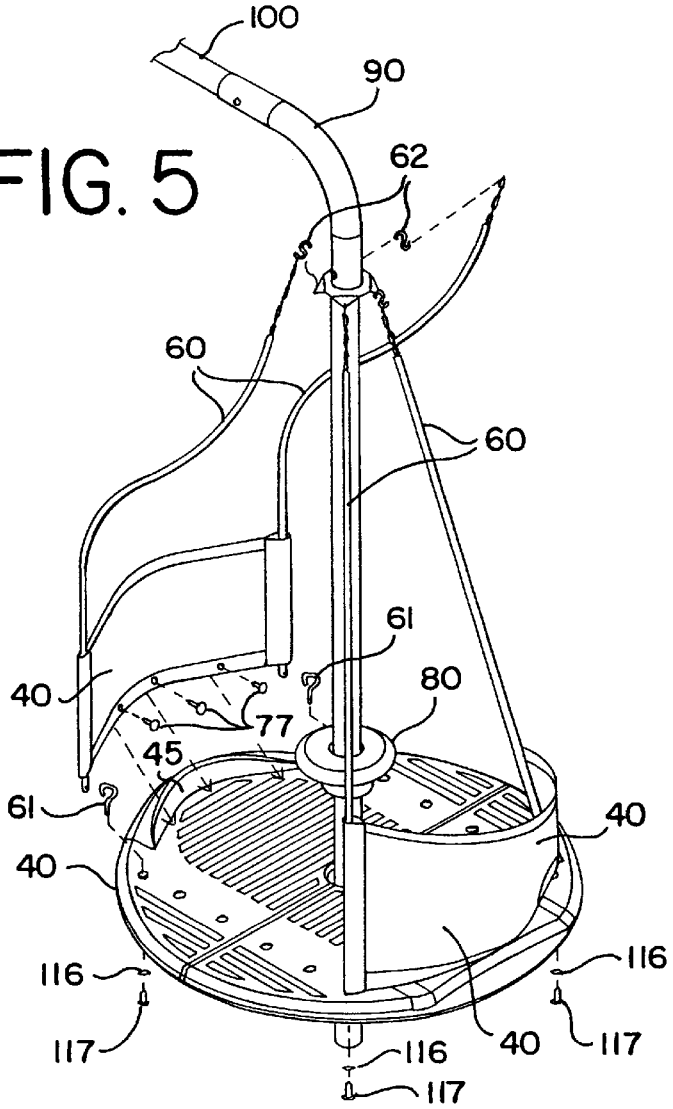
FIG. 5 is an exploded view of a preferred embodiment of the back support and the hand wheel, as well as an isometric illustration of the support assembly, the pole member, the seat member, the back support and the hand wheel shown in FIG. 1.

As shown in FIG. 5, in a preferred embodiment each back support 70 is a rectangular flexible vinyl mesh having four sides. This FIG. 5 shows that two sides 71 and 72 of the back support 70 are substantially parallel to each other and to the plane of the seat member. The other two sides are substantially parallel to each other and contain a passageway 73 through which the tension members 60 may be threaded as shown below. The back support 70 as shown in FIG. 5 contains at least three holes in a row on one side. The distance between each hole should be approximately the same distance as the holes in the raised section 45 of the seat member 40 as previously described.

The back support 70 is attached to the seat member 40 by aligning the three holes of the back support 70 to the three holes in the raised section 45 of the seat member 40 and securing with push fasteners 77. The push fasteners are preferably plastic, more preferably Flexible Flyer® part number 26000700.

It should be understood by one skilled in the art that there may be fewer or greater than 2 back supports.

TENSION MEMBERS

As shown in FIG. 5, the seat member 40 is connected to the pole 20 by at least four flexible tension members 60. The tension member may be a vinyl rope, a cloth rope, metal cable or chain and is preferably a swing chain, more preferably a rubber-covered swing chain, still more preferably a 54 inch rubber-covered swing chain, and still more preferably Flexible Flyer® part number H45701W.

Each tension member 60 has a first end and a second end. The second end of each tension member 60 is threaded through one passageway 73 of the back support 70 and secured to the seat member 40 by a bolt 61 attached to the second end of the tension member 60. The bolt 61 is preferably metal formed, more preferably a metal formed eye bolt, still more preferably a 5⁄16 inch eye bolt, and even more preferably Flexible Flyer® part number 00203. The bolt 61 is inserted into a slotted counter sunk hole in the seat member 40 as shown in FIGS. 4 and 5. Each bolt 61 is secured to the seat member with a washer 116 nut 117 as previously described. The bottom corner of the passageway 73 of the back support 70 then pulls down over the bolt 61.

The first end of each tension member 60 is attached to the swing support plate 92 at the top end 24 of the pole 20. In particular, the first end of the tension member 60 is attached to the swing support plate by a hook 62. The hook 62 is preferably metal formed, more preferably is a metal formed S-Hook, and still more preferably Flexible Flyer® part number 26000010. The hook 62 hooks onto one of the tabs of the swing support plate 92 and is closed using pliers.

In accordance with the above, there is the option to first attach either the first or second end of the tension member 60. There is a preferred order, as shown next, because preferably the seat member 40 has been interlocked previously, and then the vertical pole member 20 can be lifted so as to align with the center hole of the assembled seat member 40, and then the pole 20 can be lowered through the center hole of the assembled seat member 40, and the pole 20 is positioned at 90° to the plane of the ground. Preferably, if the second end of the tension member 60 has been previously attached to the seat member 40 as explained, this allows the assembler merely to lift the first end of each tension member 60 to attach to the swing support plate 92. The distance between the seat number 40 and the handwheel 80 may be adjusted.

The average height of the handwheel 80 to the seat member 40 is preferably, approximately 11 inches. The preferred height of the handwheel 80 is 9 inches, 11 inches, or 13 inches above the seat member 40. The height of the seat member 40 is preferably 8 inches above the ground or more. In the preferred embodiment, the tension member 60 is a 54-inch rubber-covered swing chain, and each chain link is approximately 2 inches in length. One may cut the rubber covering to the first end of each tension member 60, which cutting exposes chain links, and then count the approximate number of chain links for the desired adjustment and attach the next chain link to the hook 62 and connect the hook 62 to one of the tabs of the swing support plate 92 at the top end 24 of the pole 20 and close the hook 62 onto the tab of the swing support plate 92.

METHOD OF USING THE PREFERRED EMBODIMENTS

Referring to FIG. 1, a method of operating a suspended merry-go-round includes the steps of: providing a merry-go-round apparatus 10 comprising a vertical pole 20 and a seat member 40 with a hole in its center and the pole 40 passing through said hole, the ground end 22 of the pole 20 engaging the ground and the top end 24 of the pole 20 being supported to hold the pole vertical. The seat member 40 is supported with flexible tension members 60 connected between the pole 20. In addition to the seat member 40 to support the weight of the child 110, the child 110 may also be supported by a back support 70.

A child 110 can sit on the seat member 40 of the apparatus 10 and rotate the seat member 40 about the pole to give the child 110 a ride on the merry-go-round 10. The rotation may be provided by a hand wheel 80. The child 110 may use the tension members 60 as hand rails to hold on during the rotation. The bearing provided by the bearing washer 91 and swing support plate 92 allow the suspended seat member to freely turn about the pole member.

SCOPE OF INVENTION

It should be appreciated that the apparatus and method of the present invention is capable of being incorporated in the form of a variety of embodiments, only some of which have been described above. The invention may be embodied in other forms without departing from its spirit or essential characteristics.

Therefore, while the present invention has been described in terms of preferred embodiments, it is noted that this description has been provided by way of explanation and illustration, and not restrictive. Clearly various alternatives to these preferred embodiments are possible and within the scope of this invention, and all changes that come within the meaning and range of equivalency of the claims are embraced to be within their scope, the scope of which is defined by the appended claims.

I claim:

1. A child's suspended merry-go-round apparatus, comprising:

a) a vertical pole member having a ground end and a top end wherein said top end is attached to a support beam by a support assembly; and b) a rotatable seat member having a sifting surface with an opening at its center with said pole member passing therethrough, and wherein said seat member is attached to said pole member by flexible tension members.

2. The apparatus of claim 1 wherein the top end of the pole member is attached to a swing set support beam by said support assembly.

3. The apparatus of claim 2 wherein the support assembly is a tube with a first end fastened to the swing set support beam and a second end fastened to the top end of the pole member.

4. The apparatus of claim 3 wherein the first end of the support assembly has a bearing washer and a swing support plate that fit over the tube until the bearing washer and the swing support plate rest on a bearing support fixed to the pole member.

5. The apparatus of claim 4 wherein the first end of the tube is secured to the swing set support beam.

6. The apparatus of claim 3 wherein the pole member is secured to the second end of the tube.

7. The apparatus of claim 1 wherein the flexible tension members attach to a bearing supported by the pole member.

8. The apparatus of claim 1 further comprising a hand wheel secured to the pole member above the seat member.

9. The apparatus of claim 8 wherein the hand wheel has an opening at its center.

10. The apparatus of claim 9 wherein the hand wheel is secured to the pole member.

11. The apparatus of claim 1 wherein the seat member is a substantially flat platform disk.

12. The apparatus of claim 1 wherein the seat member is a blow molded plastic shell having multiple sections adapted so as to interlock and form the seat member with the opening at its center for the pole member to pass therethrough.

13. The apparatus of claim 12 wherein the multiple sections comprise interlocked semicircular halves and are further connected by two support bars through slots in the platform disk.

14. The apparatus of claim 1 further comprising a back support.

15. The apparatus of claim 14 wherein the back support is selected from the group consisting of plastic, vinyl, vinyl mesh, canvass, and cloth.

16. The apparatus of claim 14 wherein the back support is flexible and attached to the seat member by at least three fasteners.

17. The apparatus of claim 14 wherein there are at least two back supports.

18. The apparatus of claim 1 wherein the seat member is connected to the pole member by at least four tension members each having a first end and a second end.

19. The apparatus of claim 18 wherein the first end of each tension member is attached to a swing support plate rotatable on a bearing proximate the top end of the pole member.

20. The apparatus of claim 19 wherein the first end of each tension member is attached to the swing support plate by an S-Hook.

21. The apparatus of claim 18 wherein the second end of each tension member is threaded through one of the sides of a back support and secured to the seat member.

22. The apparatus of claim 1 wherein the tension member is selected from the group consisting of a swing chain, a vinyl rope, a cloth rope, a metal cable and a rubber-covered swing chain.

23. A child's suspended merry-go-round apparatus, comprising:

a) a vertical pole member having a ground end and a top end wherein said top end is attached to a support beam by a support assembly;

b) a rotatable seat member having a sitting surface with an opening at its center with said pole member passing therethrough, and wherein said seat member is attached to said pole member by tension members; and c) a back support.

24. The apparatus of claim 23 wherein the back support is configured so as to attach to the seat member.

25. The apparatus of claim 24 wherein the back support is selected from the group consisting of plastic, vinyl, vinyl mesh, canvass, and cloth.

26. The apparatus of claim 24 wherein the back support is flexible and attached to the seat member by at least three push fasteners.

27. The apparatus of claim 24 wherein there are at least two back supports.

28. The apparatus of claim 23 wherein the seat member is connected to the pole member by at least four tension members having a first end and a second end.

29. The apparatus of claim 28 wherein the second end of each tension member is threaded through one of the sides of the back support and secured to the seat member.

30. A child's suspended merry-go-round apparatus, comprising:

a) a vertical pole member having a ground end and a top end wherein said top end is attached to a support beam by a support assembly;

b) a rotatable seat member having a sitting surface with an opening at its center with said pole member passing therethrough, and wherein said seat member is attached to said pole member by flexible tension members attached to a bearing supported by said pole member;

c) a hand wheel attached to said pole member; and d) a flexible back support attached to said seat member and to said flexible means.

31. A method of operating a suspended merry-go-round comprising the steps of:

a) providing a merry-go-round apparatus comprising a vertical pole member and a seat member with a hole in its center and a pole member passing through said hole, one end of the pole member engaging the ground and an opposite end of the pole member being attached to a support beam by a support assembly to hold the pole member vertical;

b) seating a child on the seat member and supporting the seat member with flexible tension members connected between the pole member and the seat member; and c) rotating the seat member about the pole member to give the child a ride on the merry-go-round.

* * * * *